US007931777B2

(12) United States Patent
Räisänen et al.

(10) Patent No.: US 7,931,777 B2
(45) **Date of Patent: *Apr. 26, 2011**

(54) MULTI-LAYER WEB FORMATION SECTION

(75) Inventors: Kari Räisänen, Muurame (FI); Antti Poikolainen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 1073 days.

This patent is subject to a terminal disclaimer.

(21) Appl. No.: 10/597,915

(22) PCT Filed: Feb. 11, 2005

(86) PCT No.: PCT/FI2005/050026

§ 371 (c)(1),
(2), (4) Date: Aug. 28, 2006

(87) PCT Pub. No.: WO2005/078187

PCT Pub. Date: Aug. 25, 2005

(65) Prior Publication Data

US 2007/0163736 A1 Jul. 19, 2007

(30) Foreign Application Priority Data

Feb. 13, 2004 (FI) ..... 20040224

(51) Int. Cl.
*D21F 11/04* (2006.01)

(52) U.S. Cl. ..... 162/132; 162/133; 162/209; 162/217; 162/289; 162/352; 162/358.3; 162/363; 162/361

(58) Field of Classification Search ..... 162/123–133, 162/289, 298–304, 358.3, 208–210, 217, 162/351–352, 361, 363

See application file for complete search history.

(56) References Cited

U.S. PATENT DOCUMENTS

| | | | | | |
|---|---|---|---|---|---|
| 3,625,814 | A | * | 12/1971 | De Noyer | 162/299 |
| 3,856,618 | A | * | 12/1974 | Roell | 162/299 |
| 3,891,501 | A | * | 6/1975 | Oka et al. | 162/290 |
| 3,985,612 | A | * | 10/1976 | Watanabe | 162/203 |
| 4,154,645 | A | * | 5/1979 | Kankaanpaa | 162/133 |
| 4,425,187 | A | * | 1/1984 | Armstrong et al. | 162/299 |
| 4,614,566 | A | * | 9/1986 | Koponen et al. | 162/301 |
| 4,830,709 | A | * | 5/1989 | Turner et al. | 162/133 |
| 4,917,766 | A | * | 4/1990 | Koivuranta et al. | 162/301 |

(Continued)

FOREIGN PATENT DOCUMENTS

EP 0636745 A1 2/1995

(Continued)

*Primary Examiner* — José A Fortuna
(74) *Attorney, Agent, or Firm* — Stiennon & Stiennon

(57) ABSTRACT

A multi-layer web formation section has two successive wire units (300, 310) with a common wire (11). A first headbox (100) supplies fiber pulp to the first wire unit (300) forming a first partial web (W1). A second headbox (110) supplies a new fiber pulp layer to the forward end of the second wire unit (310) atop the first partial web. A first non-pulsating dewatering zone (Z1*b*) in the forward end of a two-wire stretch of the second wire unit (310) has a first formation shoe (200*b*) with a curved cap (201) placed on the side of the new layer having openings (202) extending through the cap (201) with an under-pressure (P) affecting therethrough. A two-wire stretch of the second wire unit (310) has a second pulsating dewatering zone (Z2*b*) formed by fixed dewatering lists (210*b*), between which there are gaps (220*b*) and an under-pressure (Pb) affecting in these.

33 Claims, 6 Drawing Sheets

U.S. PATENT DOCUMENTS

| | | | | |
|---|---|---|---|---|
| 5,259,929 | A * | 11/1993 | Bubik et al. | 162/301 |
| 5,427,654 | A | 6/1995 | Grey et al. | |
| 5,607,555 | A * | 3/1997 | Grossmann et al. | 162/301 |
| 5,914,009 | A * | 6/1999 | Kotitschke | 162/301 |
| 5,972,168 | A | 10/1999 | Egelhof et al. | |
| 6,342,125 | B1 * | 1/2002 | Nordstrom | 162/132 |
| 6,372,091 | B2 * | 4/2002 | Wildfong et al. | 162/301 |
| 6,375,799 | B1 * | 4/2002 | Halmschlager et al. | 162/186 |
| 6,464,835 | B1 * | 10/2002 | Raisanen et al. | 162/203 |
| 6,616,811 | B2 * | 9/2003 | Wassermann et al. | 162/304 |
| 6,942,760 | B1 * | 9/2005 | Heikkila et al. | 162/306 |
| 7,300,553 | B2 * | 11/2007 | Poikolainen et al. | 162/301 |
| 7,364,643 | B2 * | 4/2008 | Poikolainen et al. | 162/203 |
| 7,608,165 | B2 * | 10/2009 | Raisanen et al. | 162/132 |
| 2001/0025697 | A1 | 10/2001 | Wildfong et al. | |
| 2003/0000666 | A1 * | 1/2003 | Mansson et al. | 162/123 |
| 2005/0241792 | A1 * | 11/2005 | Poikolainen et al. | 162/301 |
| 2006/0162890 | A1 * | 7/2006 | Poikolainen et al. | 162/203 |
| 2007/0158042 | A1 * | 7/2007 | Raisanen et al. | 162/133 |
| 2007/0163736 | A1 * | 7/2007 | Raisanen et al. | 162/132 |
| 2007/0235153 | A1 * | 10/2007 | Poikolainen et al. | 162/352 |
| 2008/0115902 | A1 * | 5/2008 | Poikolainen et al. | 162/301 |
| 2009/0165973 | A1 * | 7/2009 | Aula et al. | 162/133 |

FOREIGN PATENT DOCUMENTS

| | | | |
|---|---|---|---|
| GB | 2041030 | A * | 9/1980 |
| GB | 2094364 | A | 9/1982 |
| WO | WO 02070817 | A1 * | 9/2002 |
| WO | 2005078187 | A1 | 8/2005 |
| WO | WO 2005078187 | A1 * | 8/2005 |
| WO | WO 2005078188 | A1 * | 8/2005 |
| WO | WO 2007096467 | A1 * | 8/2007 |
| WO | WO 2008000900 | A1 * | 1/2008 |

* cited by examiner

MULTI-LAYER WEB FORMATION SECTION

CROSS REFERENCES TO RELATED APPLICATIONS

This application is a U.S. national stage application of international app. No. PCT/FI2005/050026, filed Feb. 11, 2005, the disclosure of which is incorporated by reference herein, and claims priority on Finnish App. No. 20040224, filed Feb. 13, 2004.

STATEMENT AS TO RIGHTS TO INVENTIONS MADE UNDER FEDERALLY SPONSORED RESEARCH AND DEVELOPMENT

Not applicable.

BACKGROUND OF THE INVENTION

In the formation section according to the invention, a multi-layer web is made in at least two successive wire units having one common web. The first partial web is formed in a first wire unit, which may be a single-wire or a two-wire unit. After the first wire unit the first partial web is guided into the second wire unit, which is equipped with a two-wire section and wherein a new pulp layer is supplied by a headbox atop the first partial web at the beginning of the two-wire section of the second wire unit. The second wire unit may be followed by a third wire unit, a fourth wire unit etc., and in each one a new pulp layer is supplied by a headbox atop the preceding layers at the beginning of the two-wire section of the concerned wire unit.

When a web is made of aqueous wood-fiber stock, water is removed from the pulp on the formation section through the formation wire or formation wires in order to start the web formation. The wood pulp fibers remain randomly distributed on the formation wire or in between the formation wires, which are travelling together.

Fiber pulps of different types are used depending on the quality of web to be made. The water quantity, which can be removed from different fiber pulps in order to achieve a web of good quality, is a function of many factors, such as, for example, a function of the desired basis weight of the web, the designed velocity of the machine, and the desired level of fines, fibers and fillers in the final product.

Equipment of several types are known in the web formation section, that is, in the former, such as foil lists, suction boxes, hitch rolls, suction rolls and rolls provided with an open surface, which have been used in several different formations and orders in an attempt to optimize the quantity of removed water, the time and location in the formation of the web. Making a web is still an art in part and science in part in that simply removing water as quickly as possible will not produce a final product of optimum quality. In other words, making a final product of a high quality especially at high velocities is a function of the dewatering quantity, the dewatering method, the time of dewatering and the location of dewatering.

When it is desirable to maintain or improve the quality of the final product when proceeding to higher production speeds, unforeseeable problems often occur, in consequence of which either the production quantity must be reduced to maintain the desired quality or the desired quantity must be given up in order to achieve a higher production quantity.

It is known in the state of the art to use formation shoes to guide one or two formation wires on the formation section. It is also known to use a so-called formation roll provided with an open surface, for example, a perforated one, to receive water into the formation roll from the fiber pulp lying on the formation wire.

The state-of-the-art list elements or foils of formation shoes or list shoes, which have a curved surface or which are planar, are arranged in the cross machine direction at right angles to the travelling direction of the formation wire. In between the list elements there are gaps defining leading edges for the list elements. A stock jet is directed against the formation wire over the leading edge of the formation shoe/list in such a way that part of the water contained in the stock jet will travel through the formation wire to end up below the shoe/list. Each foil, list element or formation shoe is either open at its bottom to the pressure of the air outside or they are connected to a vacuum source in order to improve the dewatering process by forcing water into the gaps in between the foils or list elements. The list elements constitute the cap of the foil or formation shoe.

When increasing machine velocities, new phenomena will occur in the web formation and they will affect the machine runnability and the looks of the produced final product as well as its internal structure. An undesirable distribution of fines and fillers may occur in the surface or internal parts of the final product, whereby retention will suffer.

Two-wire formers used in board-making machines and in papermaking machines can be divided into two main types, which are the roll jaw former and the list jaw former.

The roll jaw former, wherein the pulp jet of the headbox hits a roll having a relatively large radius, is insensitive to minor geometric errors, to errors in the jet quality and to external effects, such as air resistance and water drops. As regards characteristics in the Z direction, such as the distribution of fillers and anisotropy of fibers, an excellent two-sidedness is achieved. This is so because the fiber mat is at first formed at the same time on both wires at a constant dewatering pressure (that is, non-pulsatingly). A good retention is also achieved thanks to the constant dewatering pressure in the initial part of the dewatering zone.

A drawback of the roll jaw former is that the rotation of the formation roll brings about an under-pressure pulse on the discharge side of the roll nip. This under-pressure pulse partly damages (crushes) the structure of the formed web as it is travelling from the formation roll's dewatering zone where a constant pressure exists to the following dewatering zone where a pulsating pressure exists, if the web is too wet at this point. Hereby the damaged web can no longer withstand powerful pulsating, whereby the dewatering must be limited in the pulsating dewatering zone. The price of the formation roll and its spare parts as well as the need for roll service and the resulting time of machine standstill also constitute a disadvantage. In addition, it has been found to be a problem with the roll jaw former that the dewatering capacity is not sufficient at high velocities and with dense pulps. In addition, the big rotating roll forms a source of vibrations in the formation section. In practice, the radius of the formation roll cannot be very long, whereby the wires travelling over it are subjected to a great force directed towards the shell. For this reason, the outer wire tends to attach at its edges to the inner wire, whereby the pulp located in between the wires is subjected, especially when the headbox jet is very thick, to a flow motion directed towards the center, in consequence of which the orientation of fibers becomes less advantageous. The big formation roll also takes much space and, in addition, a standby roll is also needed at all times.

In a list jaw former, the pulp jet of the headbox hits a shoe having a relatively long radius and where pulsating dewatering is pursued. Due to the pulsating dewatering right at the beginning of the formation section, the former has a good formation potential. Since all dewatering components are fixed, acquisition and service costs are lower than when using a roll as the first dewatering device.

However, the list jaw former is sensitive to many errors, such as changes occurring in the pulp jet, and this circumstance restricts the former's efficient operation. The dewatering is quite asymmetric to begin with, which in the Z direction results in unequal sidedness in the web structure, especially as regards the distribution of fillers and the anisotropy of fiber orientation. Since the dewatering of pulp is done under a pulsating pressure to begin with, retention is low.

The roll jaw former and the list jaw former may also be combined to form a roll-list jaw former. A non-pulsating dewatering zone together with a pulsating dewatering zone are used as a combination in the roll-list jaw former. The former's first non-pulsating dewatering zone comprises a formation roll (a suction roll provided with an open surface), after which a pulsating dewatering zone is arranged, wherein a loading element-suction box combination is located. With such an arrangement a good retention and a symmetric paper have been achieved, but poorer formation results than with the traditional list jaw formers. This is due to the fact that the rotational motion of the formation roll brings about an under-pressure peak in the web after the formation roll, which will damage the web already formed.

The big rotating roll of the roll-list jaw former forms a vibration source in the formation section. In practice, the radius of the formation roll cannot be very long, whereby the wires travelling over it are subjected to a strong force directed towards the shell. For this reason, the outer wire tends to attach at its edges to the inner wire, whereby the pulp located in between the wires is subjected, especially with very thick headbox jets, to a flow motion directed towards the center, in consequence of which the fiber orientation becomes less advantageous. A big formation roll also takes much space and, in addition, a standby roll is also required at all times.

U.S. Pat. No. 5,427,654 presents a multi-layer web formation section having two successive wire units. The first wire unit is a fourdrinier wire unit, wherein the bottom layer is formed on a fourdrinier wire loop, and the second wire unit is a two-wire unit, which is formed by the fourdrinier wire of a fourdrinier wire unit and by a separate top wire. At its lower surface the fourdrinier wire is supported by an adjustable shoe with a curved surface before the two-wire stretch. This adjustable shoe can be used to adjust the angle, at which the fourdrinier wire enters the two-wire stretch. A secondary headbox supplies a pulp suspension jet on to the bottom layer into a jaw formed at the beginning of the two-wire stretch. The two-wire stretch has two successive pulsating dewatering zones.

In U.S. Pat. No. 5,427,654, a first pulsating dewatering zone is located at the beginning of the two-wire stretch. This first pulsating dewatering zone comprises a curved dewatering shoe under the fourdrinier wire, with which a part of the water of the surface layer is removed by the tension of the wires to the outside by way of the top surface of the surface web. At the beginning of the two-wire stretch before the curved dewatering shoe and above the top wire an under-pressure box is located, which is divided into chambers and which is used for collecting the water discharging through the top surface of the surface layer. Under the fourdrinier wire at the under-pressure box dewatering foils are also located to boost the dewatering from the web. In addition, the curved dewatering shoe is provided with lists in the cross machine direction and with an under-pressure affecting in between the lists. In a solution of this kind, the thickness of the lip jet of the secondary headbox must not exceed an approximate value of 10 mm, because the pulsating dewatering will otherwise cause too high pressure peaks in the web.

In U.S. Pat. No. 5,427,654, the pulsating dewatering zone at the beginning of the two-wire stretch is followed by a second pulsating dewatering zone. This second pulsating dewatering zone comprises after the curved dewatering shoe of the first dewatering zone a reversed suction box located above the top wire and provided with a curved surface. In the curved surface of the reversed suction box there are lists in the cross machine direction, and an under-pressure affects in the gaps between the lists. Below the fourdrinier wire at the suction box dewatering foils are arranged at the gaps between the lists of the suction box.

SUMMARY OF THE INVENTION

The solution according to the invention constitutes an improvement on the state-of-the-art solutions.

In the formation section according to the invention there are at least two successive wire units, which have one common web. The first wire unit is either a single-wire or a two-wire unit, to which a stock jet is supplied by a first headbox in order to form a first partial web. The second wire unit is a two-wire unit, and in the jaw of the forward end of its two-wire stretch a new pulp layer is supplied by a second headbox on to the first partial web. The dewatering of this two-wire stretch of the second wire unit is both structurally and process—technically a combination of two elements in such a way that all the advantages of a list jaw former and a roll jaw former can be achieved without their associated drawbacks.

The first element is a fixed formation shoe having a curved cap and provided with openings extending through the cap, in which formation shoe it is possible to use under-pressure to control and boost the dewatering. The formation shoe is constructed in such a way that dewatering may take place freely at the same time through both formation wires travelling over the curved cap of the formation shoe. The cap of the formation shoe provides an essentially constant dewatering pressure according to the equation $P=T/R$, wherein $P$=pressure of the liquid in between the formation wires travelling over the formation shoe, $T$=tension of the outermost web, and $R$=radius of curvature of the fixed formation shoe. The intention is that the formation shoe will not cause any pulsating dewatering even when the dewatering is boosted by under-pressure. The formation shoe can be thought as being the curve of a "fixed roll" provided with an open surface. The cap has a large open surface area and through openings it is connected to an under-pressure chamber located inside the formation shoe. The openings in the cap of the formation shoe are formed in such a way that pulsating dewatering is avoided, which would result if the openings were formed by longitudinal gaps in the cross machine direction. In order to bring about this essentially constant pressure, these openings are either holes, gaps arranged essentially in the machine direction, wave-like gaps, upstanding contact surfaces in the machine direction to carry the web above the shoe cap, etc. The cross-section of the holes may be round, square, elliptic or polygonal.

The second dewatering element is a pulsating dewatering element comprising fixed dewatering lists mounted on the other side of the formation wires in the cross machine direction and provided with gaps. In connection with the fixed lists it is possible to use under-pressure, which through the gaps in between the lists affects the pulp located in between the formation wires. In addition, in the gaps between the fixed dewatering lists it is possible to locate adjustable dewatering lists on the side opposite to the formation wires in relation to the fixed dewatering lists. These adjustable dewatering lists are used to boost further the pulsating impact on the web.

Dewatering first takes place in the non-pulsating dewatering zone essentially under a constant pressure as two-sided dewatering, owing to which the web structure is symmetric in the Z direction.

No under-pressure peak occurs on the output side of the non-pulsating dewatering zone, because the structure is fixed. In this way that tendency damaging the web is avoided, which relates to the non-pulsating dewatering zone formed by a roll.

In the non-pulsating dewatering zone water can be removed even from a very wet web without breaking the structure of the web. In consequence of this, the web may be brought very wet to the formation shoe, where water is removed from the web through the openings of the non-pulsating formation shoe under the effect of under-pressure existing in the openings. A very effective dewatering is provided in this manner. After the non-pulsating dewatering zone the web is guided into the pulsating dewatering zone with such a dry-matter content that formation of the web can be improved by pulsating dewatering. The higher dewatering capacity also allows a higher production rate.

The capital and maintenance costs of a non-pulsating fixed formation shoe are lower than those of a roll and standby roll.

According to each purpose of use, the radius of the non-pulsating fixed formation shoe and the shoe length in the machine direction can be changed within a larger range than would be practical when using a roll. The fixed formation shoe may also be formed by several curves, for example, in such a way that the radius of the formation shoe is longer at the input end, but it becomes progressively shorter as a spiral-like arch towards the output end. In such a case the dewatering pressure is no longer constant over the formation shoe, but it remains non-pulsating nevertheless. The possibility of changing the radius in both the manners told above as well as the shoe length means that non-pulsating dewatering can always be designed to be suitable according to each application in a considerably easier way than is possible to do in connection with a roll.

The combination of a non-pulsating dewatering zone and a pulsating dewatering zone allows easier control of the dewatering between the non-pulsating and the pulsating dewatering zones, whereby the dewatering can be controlled more easily and better than in the known formers. In consequence of this, the balance between formation and retention can be better controlled and the strength properties of the web can be optimized. By adjusting the under-pressure level of the non-pulsating formation shoe it is possible to adjust the distribution of dewatering between the top and bottom surfaces of the web, which for its part affects the distribution of fines between the top and bottom surfaces. Hereby the fines content can be controlled in that surface of the pulp, which is combined with the partial web formed in the preceding wire unit. There must be sufficiently fines in the joining surfaces of the partial webs, so that a strong bond is formed between the partial webs.

The great dewatering capacity of the non-pulsating formation shoe at the beginning of the two-wire stretch makes it possible to optimize the consistency of the web entering the two-wire stretch according to the final product to be made. In the second headbox located at the beginning of the two-wire stretch it is possible to use a consistency lower than the normal one and a lip opening bigger than the normal one. The lower input consistency improves the formation of the web to be formed. On the fixed formation shoe located at the beginning of the two-wire stretch on the side of the new pulp layer it is possible to remove enough water from the new pulp layer supplied atop the first partial web. It is hardly possible to remove any water from this new pulp layer through the first partial web already formed.

In a situation where the first wire unit is a fourdrinier wire unit, the fourdrinier wire stretch may also be shortened, because the dry-matter content of the first partial web may also be lower than usual when proceeding to the two-wire stretch of the second wire unit. The thickness of the first partial web and of the new pulp layer to be supplied atop it may also vary within a larger range than is possible at present when proceeding to the two-wire stretch of the second wire unit. In the fourdrinier wire stretch one may also use a non-pulsating formation shoe for the dewatering, whereby the high dewatering capacity of the formation shoe works in favor of a shortening of the fourdrinier wire stretch. The improved dewatering capacity allows a higher production rate.

In the fourdrinier wire unit, fines discharge from the first partial web formed on the fourdrinier wire stretch mainly through the bottom surface located against the fourdrinier wire, whereby fines will remain in the top surface of the first partial web. The second partial web is formed atop the top surface of the first partial web, where the quantity of fines is bigger. This improves the strength between the partial webs and is advantageous for joining the partial webs together.

In the following the invention will be described by referring to the figures shown in the appended drawings.

DESCRIPTION OF THE PREFERRED EMBODIMENTS

Figure 1:
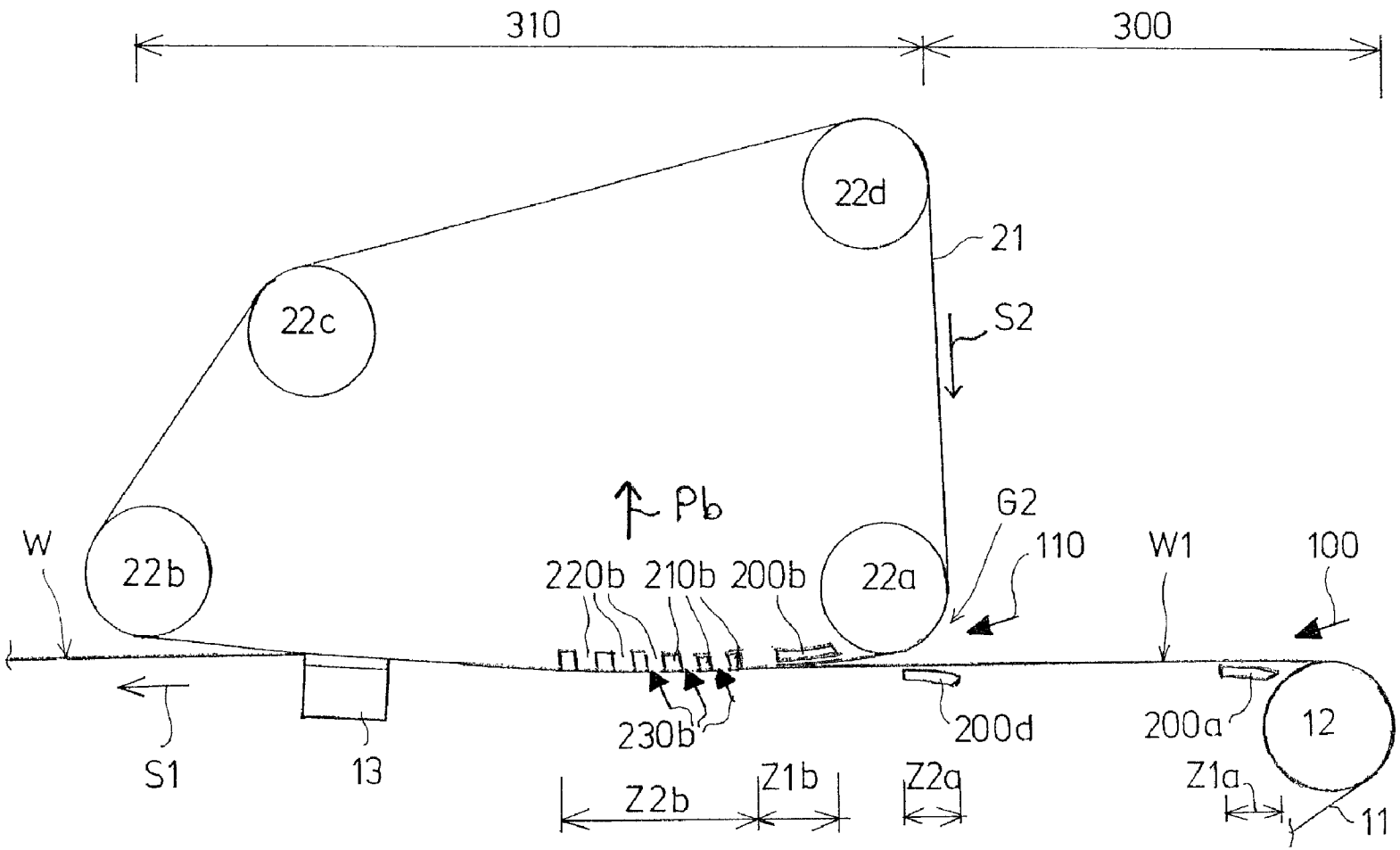
FIG. 1 is a schematic side view of a formation section according to the invention provided with two wire units.

FIG. 1 shows a formation section provided with two successive wire units 300, 310. The first wire unit 300 is a single-wire unit and the second wire unit 310 is a two-wire unit, and the wire units 300, 310 have one wire 11 in common.

The first wire unit 300 is formed by a fourdrinier wire loop 11 and by dewatering equipment 200*a*, 200*d* arranged under the fourdrinier wire 11. A first headbox 100 supplies a pulp suspension jet on to the fourdrinier wire 11 to the forward end of the fourdrinier wire stretch, immediately after a breast roll 12 in order to form a first partial web W1. The travelling direction of the fourdrinier wire 11 is indicated by an arrow S1, which thus is also the machine direction.

After the first wire unit 300 there is a second wire unit 310 having a two-wire stretch essentially in the horizontal direction. The fourdrinier wire 11 forms the first wire of the second wire unit 310 while a separate top wire 21 forms the second wire. The top wire 21 is made to form an endless wire loop with the aid of hitch rolls and guide rolls 22*a*, 22*b*, 22*c*, 22*d*. The first roll 22*a* of the top wire loop 21 is fitted above the fourdrinier wire 11 in such a way that the top wire 21 and the fourdrinier wire 11 form a wedge-like jaw G2 at the forward end of the two-wire stretch of the second wire unit 310. A second headbox 110 supplies a pulp suspension jet on to the first partial web W1 into the jaw G2 of the second wire unit 310. The multi-layer web formed by the first partial web W1 and by the new pulp layer supplied on top of it is then guided in between the wires 11, 21 of the second wire unit 310. The travelling direction of the top wire 21 is indicated by an arrow S2.

At the forward end of the two-wire stretch of the second wire unit 310 two successive dewatering zones Z1*b*, Z2*b* are formed.

The first dewatering zone Z1*b* is formed by a first formation shoe 200*b*, which has a cap provided with openings and located against the inner surface of top wire 21. The first formation shoe 200*b* is connected to an under-pressure source (not shown in the figure), whereby an under-pressure impact is directed to the web through the openings in the cap of the formation shoe 200*b*. The first formation shoe 200*b* is further arranged in such a way that on the fourdrinier wire 11 the fiber pulp formed by the first partial web W1 arriving into the jaw G2 of the second wire unit 310 and by the new pulp layer supplied on top of it by the second headbox 110 will not hit the leading edge of the first formation shoe 200*b*, but after the leading edge it is guided to the area of the cap of the first formation shoe 200*b*. Thus, the leading edge of the first formation shoe 200*b* will not remove water from the fiber pulp. The first formation shoe 200*b* causes non-pulsating dewatering in the fiber pulp travelling in between the wires 11, 21. With the first formation shoe 200*b* it is possible to remove plenty of water from the new pulp layer supplied atop the first partial web W1 by the second headbox 110.

The second dewatering zone Z2*b* is formed by dewatering lists 210*b*, 230*b* in the cross machine direction, which are fixed and which can be loaded in a controlled manner. The fixed dewatering lists 210*b* are arranged inside the top wire 21 and they have gaps 220*b* between them, through which an under-pressure Pb can be conducted to the already partly formed web in between the top wire 21 and the fourdrinier wire 11 in order to remove water from it. Under the fourdrinier wire 11 dewatering lists 230*b* are arranged, which can be controlled and which are loaded against the inner surface of the fourdrinier wire 11 and which are located at the gaps 220*b* between the fixed dewatering lists 210*b*. The dewatering lists 210*b*, 230*b* cause pulsating dewatering in the pulp travelling between the wires 11, 21. The formation of the web to be formed can be improved by this strongly pulsating second dewatering zone.

After the dewatering zones Z1*b*, Z2*b* there follows a transfer suction box 13, which is arranged under the fourdrinier wire 11 and which is used to make sure that the formed multi-layer web W will after the two-wire stretch of the second wire unit 310 follow the fourdrinier wire 11, from which it will later at a pick-up point (not shown) be picked up for further treatment.

In the first wire unit 300 there are also two dewatering zones Z1*a*, Z2*a*. At the first headbox 100 a second fixed formation shoe 200*a* is arranged under the fourdrinier wire 11. The pulp suspension jet of the first headbox 100 hits the second formation shoe 200*a*, preferably at an angle of 2-6 degrees, in the area immediately after the leading edge of the second formation shoe 200*a*. At the second headbox 110 a fourth fixed formation shoe 200*d* is arranged under the fourdrinier wire 11. The pulp suspension jet of the second headbox 110 hits the first partial web W1 preferably at an angle of 2-8 degrees, in the area of fourdrinier wire 11 immediately after the output edge of the fourth formation shoe 200*d*. These formation shoes 200*a*, 200*d* have a structure similar to that of the first formation shoe 200*b* located at the beginning of the two-wire stretch of the second wire unit 310. The formation shoes 200*a*, 200*d* are arranged in such a way that the pulp travelling on the fourdrinier wire 11 will not hit the leading edge of the formation shoe 200*a*, 200*d*, but after the leading edge it is guided into the area of the cap of the formation shoe 200*a*, 200*d*. Thus, the leading edge of the formation shoe 200*a*, 200*d* does not remove water from the fiber pulp. The formation shoes 200*a*, 200*d* cause non-pulsating dewatering in the fiber pulp travelling on the fourdrinier wire 11.

Figure 2:
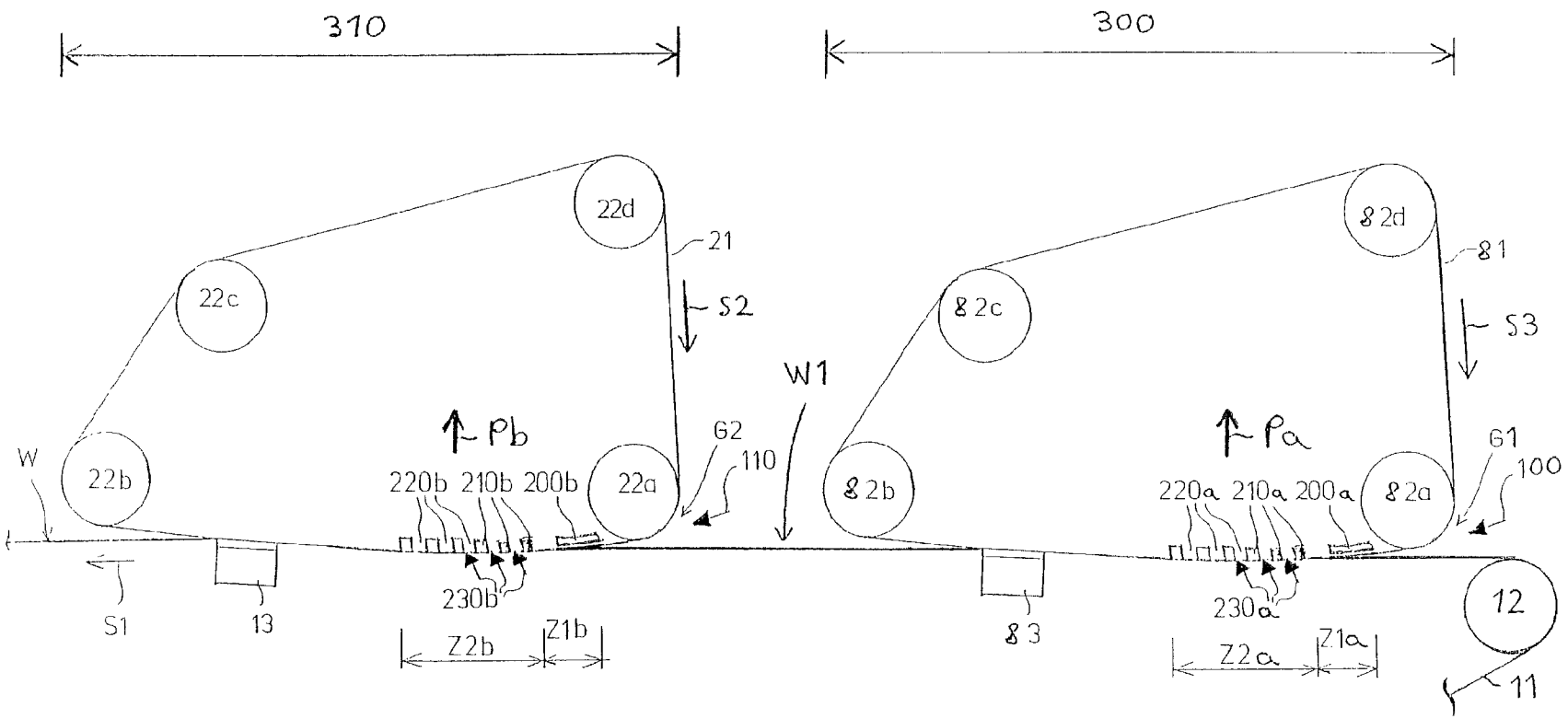
FIG. 2 is a schematic side view of another formation section according to the invention provided with two wire units.

FIG. 2 shows another formation section provided with two successive wire units 300, 310. Both wire units 300, 310 are two-wire units and they have one wire 11 in common.

Both wire units 300, 310 are identical and they correspond to the second wire unit 310 shown in FIG. 1.

In the first wire unit 300 there is a two-wire stretch essentially in a horizontal direction. The fourdrinier wire 11 constitutes the first wire of the first wire unit 300 while a separate top wire 81 constitutes the second wire. The top wire 81 is made to form an endless wire loop with the aid of hitch rolls and guide rolls 82*a*, 82*b*, 82*c*, 82*d*. The first roll 82*a* of the top wire loop 81 is fitted above the fourdrinier wire 11 in such a way that the top wire 81 and the fourdrinier wire 11 form a wedge-like jaw G1 at the forward end of the two-wire stretch of the first wire unit 300. A first headbox 100 supplies a pulp suspension jet on to the fourdrinier wire 11 into the jaw G1 of the first wire unit 300. The travelling direction of the top wire 81 is indicated by an arrow S3.

At the forward end of the two-wire stretch of the first wire unit 300 two successive dewatering zones Z1*a*, Z2*a* are formed.

The first dewatering zone Z1*a* is formed by a second formation shoe 200*a*, which has a cap provided with openings and which is located against the inner surface of top wire 81. The second formation shoe 200*a* is connected to an under-pressure source (not shown in the figure), whereby an under-pressure impact is directed at the web through the cap openings of the formation shoe 200*a*. The second formation shoe 200*a* is further arranged in such a way that the fiber pulp on the fourdrinier wire 11 arriving into the jaw G1 of the first wire unit 300 will not hit the leading edge of the second formation shoe 200*a*, but after the leading edge it is guided into the area of the cap of the second formation shoe 200*a*. Thus, the leading edge of the second formation shoe 200*a* does not remove water from the fiber pulp. The second formation shoe 200*a* causes non-pulsating dewatering in the fiber pulp travelling in between the wires 11, 81. Plenty of water can be removed from the pulp by the second formation shoe 200*a*.

The second dewatering zone Z2*a* is formed by dewatering lists 210*a*, 230*a* in the cross machine direction, which are fixed and which can be loaded in a controlled manner. The fixed dewatering lists 210*a* are arranged inside the top wire 81 and in between them there are gaps 220*a*, through which an under-pressure Pa can be conducted to the already partly formed web located in between the top wire 81 and the fourdrinier wire 11 in order to remove water from it. Under the fourdrinier wire 11 dewatering lists 230*a* are arranged, which can be controlled and which are loaded against the inner surface of the fourdrinier wire 11 and which are located at the gaps 220*a* between the fixed dewatering lists 210*a*. The dewatering lists 210*a*, 230*a* cause pulsating dewatering in the pulp travelling between the wires 11, 81. The formation of the web to be formed can be improved by this strongly pulsating second dewatering zone.

After the dewatering zones Z1*a*, Z2*a* there follows a transfer suction box 83, which is arranged under the fourdrinier wire 11 to make sure that the formed first partial web W1 will, after the two-wire stretch of the first wire unit 300, follow the fourdrinier wire 11, on which it is transferred to the second wire unit 310.

In the jaw G2 at the forward end of the two-wire stretch of the second wire unit 310 a new pulp layer is supplied on top of the first partial web W1 by a second headbox 110. The second wire unit 310 is entirely similar to the second wire unit 310 shown in FIG. 1.

Figure 3:
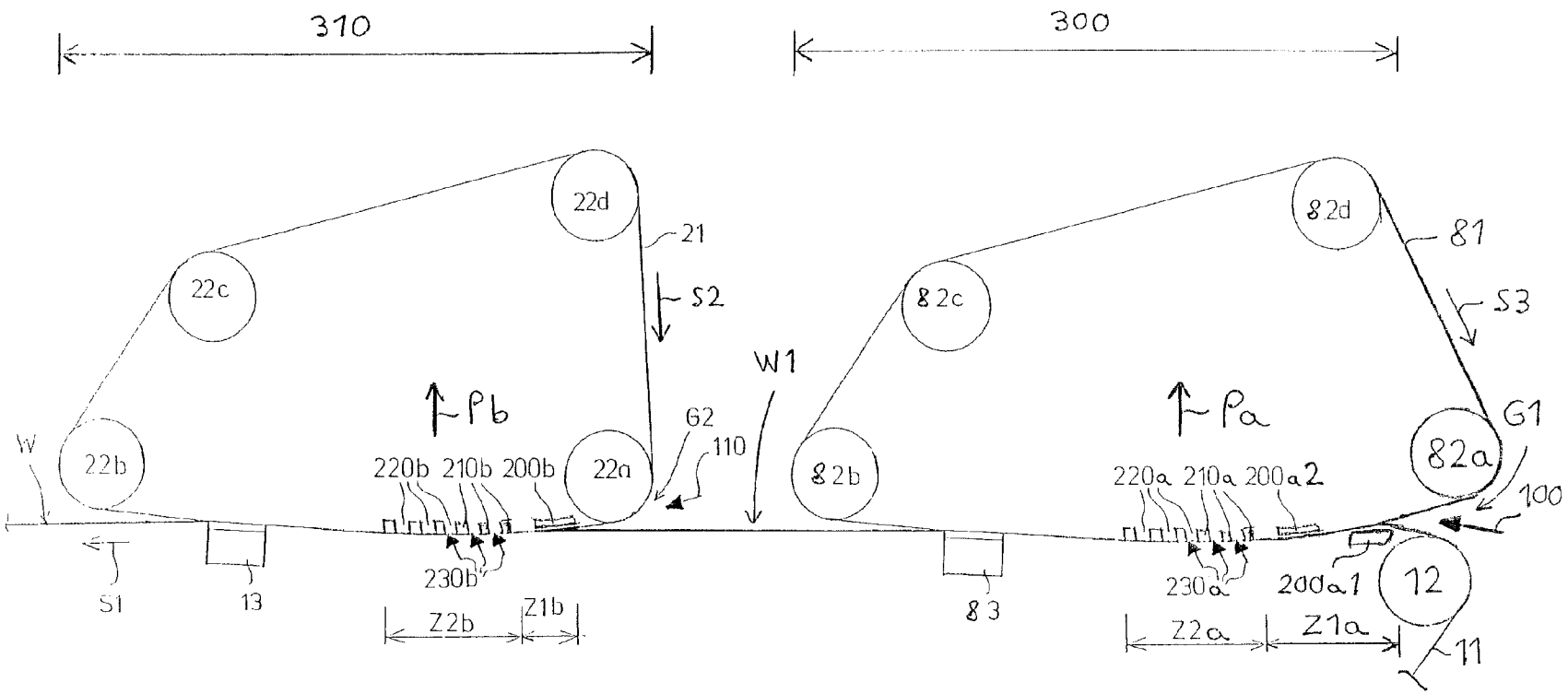
FIG. 3 is a schematic side view of a third formation section according to the invention provided with two wire units.

FIG. 3 shows a third formation section provided with two successive wire units 300, 310. Both wire units 300, 310 are two-wire units and they have one wire 11 in common. The only difference from the embodiment shown in FIG. 2 is found at the forward end of the first wire unit 300. In the beginning of the two-wire stretch there are two successive formation shoes 200*a*1, 200*a*2, which are located on opposite sides of the two-wire stretch. The first formation shoe 200*a*1 is located inside the fourdrinier wire 11 loop and the second formation shoe 200*a*2 is located inside the top wire 81 loop. The first headbox 100 supplies a pulp suspension jet towards the top wire 81, and the top wire 81 joins the fourdrinier wire 11 on the first formation shoe 200*a*1, in an area after the leading edge of the first formation shoe 200*a*1. Thus, the pulp will not contact the leading edge of the first formation shoe 200*a*1 located inside the fourdrinier wire 11, whereby the leading edge of the first formation shoe 200*a*1 does not remove water from the web.

Figure 4:
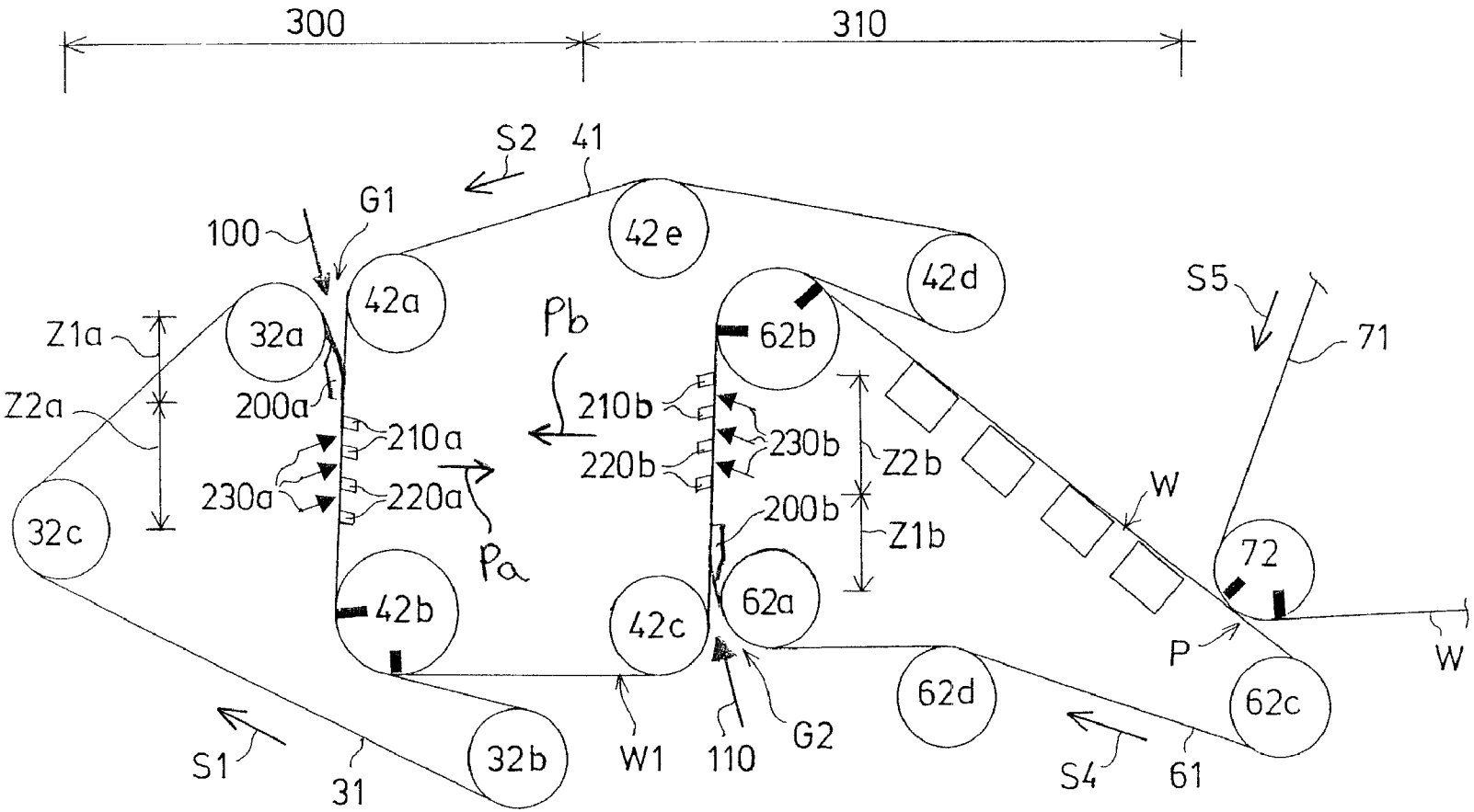
FIG. 4 is a schematic side view of a fourth formation section according to the invention provided with two wire units.

FIG. 4 shows a fourth formation section provided with two successive wire units 300, 310. Both wire units 300, 310 are two-wire units and they have one wire 41 in common.

The first wire unit 300 comprises a first wire 31, which is formed as a closed wire loop with the aid of hitch rolls and guide rolls 32*a*, 32*b*, 32*c*, and a second wire 41, which is formed as a closed wire loop with the aid of hitch rolls and guide rolls 42*a*, 42*b*, 42*c*, 42*d*, 42*e*. The wires 31, 41 have a common two-wire stretch directed downwards in a vertical plane, and a first jaw G1 is formed at the forward end of this two-wire stretch. A first headbox 100 supplies a pulp suspension jet into the first jaw G1 between the formation wires 31,41, whereupon a first partial web W1 is formed on the two-wire stretch of the first wire unit 300, where there are two successive dewatering zones Z1*a*, Z2*a*. The travelling direction of the first wire 31 is indicated by an arrow S1 and the travelling direction of the second wire 41 is indicated by an arrow S2.

At the end of the two-wire stretch of the first wire unit 300 the travelling direction of the second wire 41 is reversed with the aid of a first hitch suction roll 42*b* located inside the second wire loop 41. The first partial web W1 formed on the two-wire stretch is released from the first wire 31 and made to attach to the second wire 41 by the suction sector of the first hitch suction roll 42*a*, whereupon the first partial web W1 follows on the lower surface of the second wire 41 into the second wire unit 310.

The first wire 41 of the second wire unit 310 is formed by the second wire 41 of the first wire unit 300, which is thus formed as a closed wire loop with the aid of hitch rolls and guide rolls 42*a*, 42*b*, 42*c*, 42*d*, 42*e*. The second wire 61 of the second wire unit 310 is formed as a closed wire loop with the aid of hitch rolls and guide rolls 62*a*, 62*b*, 62*c*, 62*d*. The wires 41,61 have a common two-wire stretch directed upwards in a vertical plane and a second jaw G2 is formed at the forward end of this two-wire stretch. A second headbox 110 supplies a pulp suspension jet into the second jaw G2 between the formation wires 41, 61 atop a first partial web W1, whereupon a multi-layer web W is formed on the two-wire stretch of the second wire unit 310 in which two-wire stretch there are two successive dewatering zones Z1*b*, Z2*b*. The travelling direction of the first wire 41 is indicated by an arrow S2 and the travelling direction of the second wire 61 is indicated by an arrow S4.

At the end of the two-wire stretch of the second wire unit 310, the travelling direction of the second wire 61 is reversed with the aid of a second hitch suction roll 62*b* located inside the second wire loop 61. The multi-layer web W formed on the two-wire stretch of the second wire unit 310 is released from the first wire 41 of the second wire unit 310 and made to attach to the second wire 61 of the second wire unit 310 by the suction sector of the second hitch suction roll 62*b*, whereupon the formed multi-layer web W follows on the surface of the second wire 61 to a pick-up point P, from which the web W is transferred under the effect of under-pressure of a pick-up suction roll 72 to a pick-up fabric 71. Then the web W is transferred for further treatment on pick-up fabric 71, whose travelling direction is indicated by an arrow S5.

The dewatering arrangements of the two-wire stretch of the wire units 300, 310 are entirely similar. In each wire unit 300, 310 the dewatering arrangement is formed by two successive dewatering zones Z1*a*, Z2*a* and Z1*b*, Z2*b*.

The first dewatering zone Z1*a*, Z1*b* of wire units 300, 310 is formed by a formation shoe 200*a*, 200*b*, which is located at the beginning of the two-wire stretch and which has a cap provided with openings. The formation shoe 200*a* of the first wire unit 300 is located against the inner surface of the first wire 31 of the first wire unit 300. The formation shoe 200*b* of the second wire unit 310 is located against the inner surface of the second wire 61 of the second wire unit 310, that is, on that side of the two-wire stretch to which a new pulp layer is supplied by the second headbox 110. The formation shoe 200*a*, 200*b* is further arranged in such a way that the fiber pulp to be supplied by the headbox 100, 110 into jaw G1, G2 will not hit the leading edge of formation shoe 200*a*, 200*b*, but it is guided after the leading edge to the area of the cap of the formation shoe 200*a*, 200*b*. Thus, the leading edge of the formation shoe 200*a*, 200*b* removes no water from the fiber pulp. By using formation shoe 200*a*, 200*b*, non-pulsating dewatering is caused in the pulp travelling in between the wires 31, 41, 41, 61.

The second dewatering zone Z2*a*, Z2*b* of wire units 300, 310 is formed by dewatering lists 210*a*, 230*a*, 210*b*, 230*b* in the cross machine direction, which are fixed and which can be loaded in a controlled manner. The fixed dewatering lists 210*a*, 210*b* are arranged on the opposite side of the two-wire stretch in relation to the formation shoe 200*a*, 200*b* and between them there are gaps 220*a*, 220*b*, through which an under-pressure Pa, Pb can be conducted to the already partly formed web travelling in between the wires 31, 41, 41, 61 in order to remove water from it. The dewatering lists 230*a*, 230*b*, which can be loaded in a controlled manner, are located on the same side as the two-wire stretch in relation to formation shoes 200*a*, 200*b* at the gaps 220*a*, 220*b* between the fixed dewatering lists 210*a*, 210*b*. In the second dewatering zone Z2*a*, Z2*b*, pulsating dewatering is caused in the pulp travelling between the wires 31, 41, 41, 61.

Figure 5:
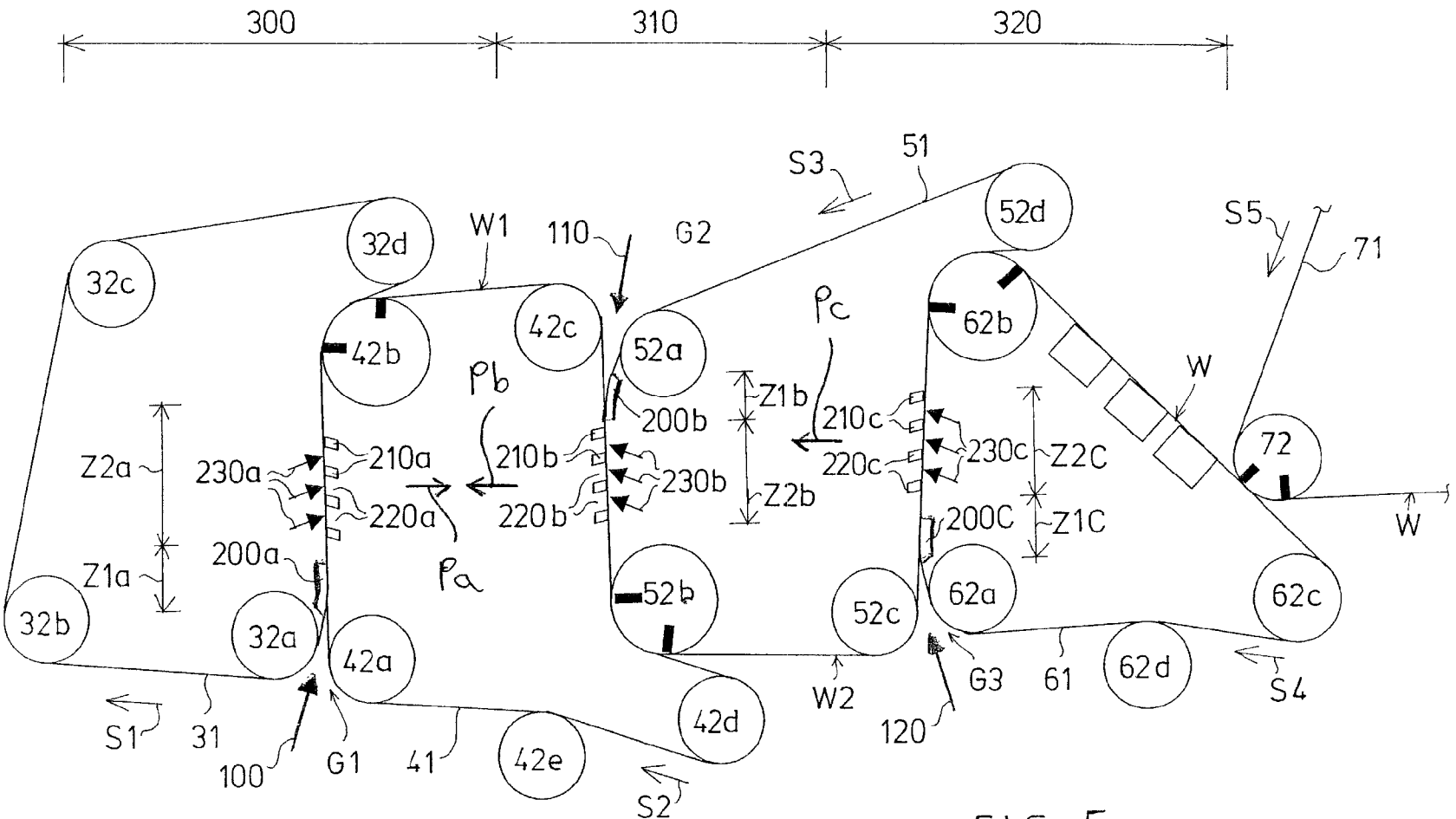
FIG. 5 is a schematic side view of a fifth formation section according to the invention provided with three wire units.

FIG. 5 shows a fifth formation section provided with three successive wire units 300, 310, 320. Two successive wire units 300, 310 and 310, 320 always have one wire 41 and 51 in common. Thus, to the embodiment shown in FIG. 5 one wire unit has been added compared with the embodiment shown in FIG. 4.

The first wire unit 300 shown in FIG. 5 is similar to the first wire unit 300 shown in FIG. 4, with the difference that the two-wire stretch is here directed upwards in a vertical plane. The third wire unit 320 shown in FIG. 5 for its part is similar to the second wire unit 310 shown in FIG. 4. The second wire unit 310 shown in FIG. 5 is similar to the first wire unit 300, but the two-wire stretch is directed downwards in a vertical plane. The first dewatering zone Z1*a* of the first wire unit 300 is formed by a fixed formation shoe 200*a*, which places itself against the inner surface of the first wire 31 of the first wire unit 300. The first dewatering zone Z1*b*, Z1*c* of the two-wire stretch of the second 310 and third 320 wire units is formed by a fixed formation shoe 200*b*, 200*c*, which places itself on that side of the two-wire stretch, to which the new pulp layer is supplied by the headbox 110, 120. The second dewatering zone Z2*a*, Z2*b*, Z2*c* is formed by fixed dewatering lists 210*a*, 210*b*, 210*c*, which are mounted on the opposite side of the two-wire stretch in relation to the formation shoe 200*a*, 200*b*, 200*c*, and by gaps 220*a*, 220*b*, 220*c* between them, through which an under-pressure Pa, Pb, Pc can be conducted to the already partly formed web travelling between the wires 31, 41, 41, 51, 51, 61 in order to remove water from it. The dewatering lists 230*a*, 230*b*, 230*c*, which can be loaded in a controlled manner, are located on the opposite side of the two-wire stretch in relation to the fixed dewatering lists 210*a*, 210*b*, 210*c* at the gaps 220*a*, 220*b*, 220*c* between the fixed dewatering lists 210*a*, 210*b*, 210*c*.

Figure 6:
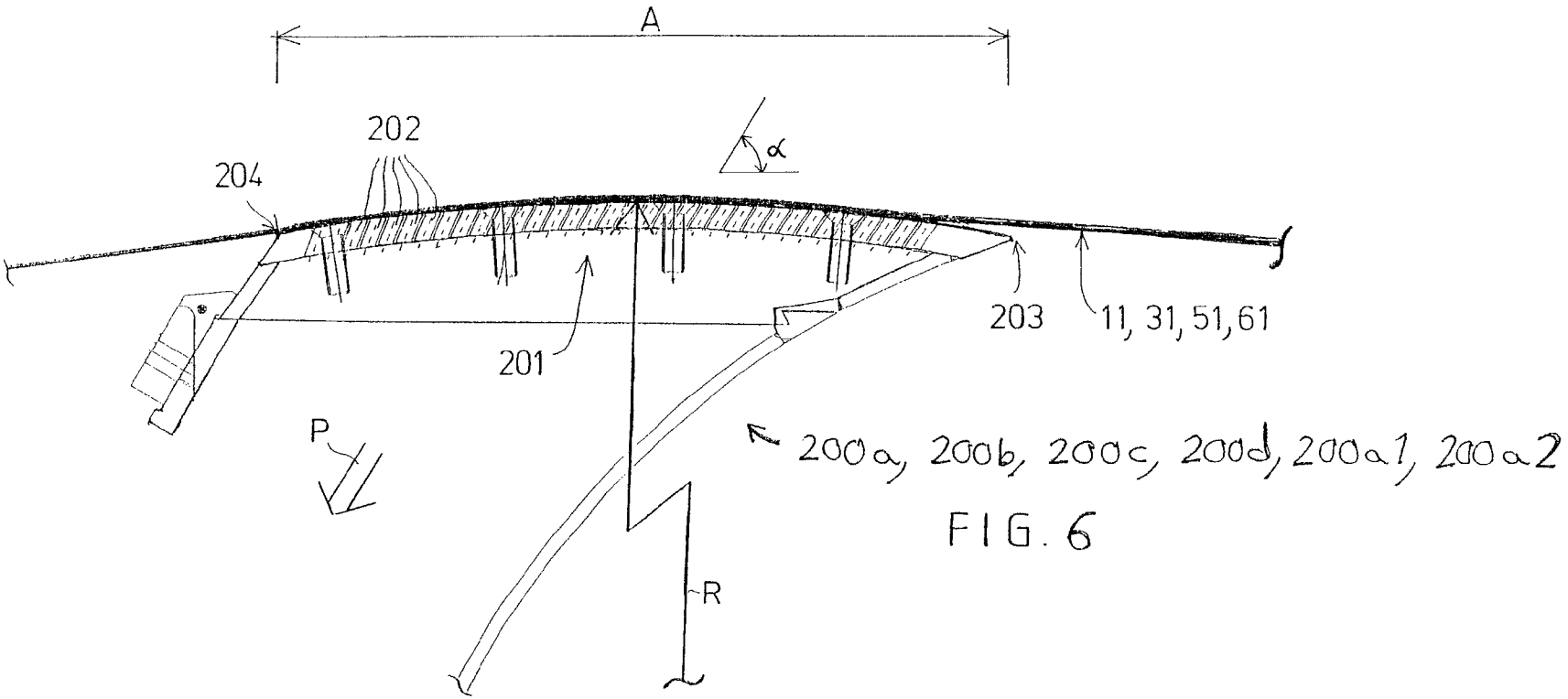
FIG. 6 shows an enlargement of a formation shoe used in the wire units of FIGS. 1-5.

FIG. 6 shows an enlargement of the fixed non-pulsating formation shoe 200*a*, 200*b*, 200*c*, 200*d*, 200*a*1, 200*a*2 shown above in FIGS. 1-5. The formation shoe has a curved cap 201, which is placed against the inner surface of the formation wire 11, 31, 51, 61 and which has a leading edge 203 and a trailing edge 204. The cap 201 has an open surface formed by openings 202 extending through the cap 201. Openings 202 may be formed by holes, grooves, gaps or equivalent. Under the cap 201 an under-pressure is arranged, which is marked by the reference mark P and illustrated by an arrow and which is used to remove water from the pulp located on the wire 11 or in between the wires 11, 21, 31, 41, 41, 61, 41, 51, 51, 61. The openings 202 are arranged in such a way in the cap 201 of the formation shoe that the open surface area of said cap 201 is large, most preferably 50-90 percent, and so that they do not due to their design and/or arrangement cause any pressure pulses in the web. Pressure pulses may be caused in the web, if the formation wire 11, 21, 31, 51, 61 travelling on cap 201 is not evenly supported over the whole area of the cap 201. Pressure pulses will not be caused, if the openings are formed by holes or by gaps essentially in the lengthwise direction of the machine. When the openings 202 are formed by holes, they are preferably arranged against the travelling direction S of the wire 11, 21, 31, 51, 61 travelling over cap 201 obliquely in relation to cap 201 in such a way that the water is better guided into them. The angle $\alpha$ between the central axis of holes 202 and a tangent to the cap's 201 outer surface is within a range of 30-60 degrees. Cap 201 is formed as a curved cap in such a way that the cap's 201 radius of curvature R is within a range of 1-20 m. The radii of curvature R of the cap 201 of formation shoes located in the two-wire stretch are within a range of 1-5 m and the radii of curvature R of the cap 201 of formation shoes located in the single-wire section are within a range of 5-20 m. The overlap angle of wire 11, 21, 31, 51, 61 in the area of cap 201 is within a range of 3-45 degrees, preferably 5-30 degrees. The cap length A in the machine direction is within a range of 200-1000 mm. Cap 201 may also be formed by several parts having different radii of curvature R. The level of under-pressure to be used in the formation shoe is preferably within a range of 1-30 kPa.

By changing the radius of curvature R of the cap 201 of the formation shoe and/or by changing the under-pressure P existing in the shoe and/or the shoe length A it is possible to control the quantity and distribution of the water removed by the formation shoe from the web.

When a non-pulsating formation shoe 200*a*, 200*d* is used for dewatering in the fourdrinier wire unit 300, the fines in the first partial web W1 discharge mainly from the surface of the first partial web W1 located against the fourdrinier wire 11, whereby fines will remain in the top surface of the first partial web W1. From the viewpoint of joining together the first partial web W1 and the fiber layer to be supplied on top of it, it is an advantage to have fines in the top surface of the first partial web W1.

In the embodiments shown in FIGS. 1-3 one or more successive wire units may be placed behind the second wire unit 310, depending on the number of layers desired in the final web. At the beginning of each two-wire unit following after the first wire unit 300 a new layer is always formed by the headbox atop the preceding layers.

In the embodiments shown in FIGS. 4-5, it is of course also possible when required to use several successive two-wire units depending on the number of layers desired in the web.

In the embodiments shown in FIGS. 4-5, the fixed dewatering lists 210*a*, 210*b*, 210*c* may also be on the same side of the two-wire stretch as the formation shoes 200*a*, 200*b*, 200*c*.

In the embodiments shown in the figures only one formation shoe is shown at the beginning of the two-wire stretch of the second wire unit, but there may also be more formation shoes. At the beginning of the two-wire stretch there may be, for example, two formation shoes mounted on opposite sides of the two-wire stretch, as is the case in the first wire unit of the formation section shown in FIG. 3. A meandering path is hereby formed on the wires, which may cause runnability problems. On the same side of the two-wire stretch there may also be several successive formation shoes, if, for example, different under-pressure levels are desired in the different formation shoes.

The headboxes 100, 110, 120 shown in the figures may be single-layer headboxes or multi-layer headboxes.

The consistency of the pulp suspension supplied by the first headbox 100 is within a range of 0.5-1.5 percent and the consistency of the pulp suspension supplied by the second headbox 110 and by the following headboxes 120 is within a range of 1.0-2.0 percent.

In the embodiment shown in FIG. 1, approximately 60-80 percent of the quantity of water contained in the pulp suspension supplied by the first headbox 100 are removed in the first wire section 300 and approximately 5-15 percent are removed in the second wire section 310. Of the quantity of water contained in the pulp suspension supplied by the second headbox 110 about 20-50 percent are removed in the first non-pulsating dewatering zone Z1*b* and about 15-30 percent are removed in the second pulsating dewatering zone Z2*b*.

In the embodiments shown in the figures the second dewatering zone Z2*b* of the second wire unit 310 is formed by fixed dewatering lists 210*b* and by dewatering lists 230*b*, which can be loaded in a controlled manner. The second dewatering zone Z2*b* may also be formed only by fixed dewatering lists 210*b*. The fixed dewatering lists 210*b* may form a direct passage for the wires travelling over them. With the under-pressure existing in the gaps 220*b* between the fixed dewatering lists 210*b* the passage of wires is somewhat deviated in said gaps 220*b*, whereby pulsating dewatering is brought about in the web located between the formation wires. The fixed dewatering lists 210*b* may also be located in such a way that they form a curved passage for the wires travelling over them. Hereby the dewatering lists 210*b* are at a small angle of about 0.5-2 degrees in relation to one another. By such an arrangement a boosted pulsating dewatering is brought about in the web located between the formation wires travelling over the dewatering lists. In both cases, the pulsating effect is boosted even more by using both fixed dewatering lists 210*b* and dewatering lists 230*b*, which can be loaded in a controlled manner.

Only some advantageous embodiments of the invention have been presented in the foregoing, and it is obvious to a professional in the art that numerous modifications can be made to them within the scope of the appended claims.

The invention claimed is:

1. A method of forming a multi-layer web in a formation section, comprising the steps of:

forming a first partial web on a first wire of a first wire unit with a pulp suspension jet supplied by a first headbox at a forward end of the first wire unit;

guiding the first wire of the first forming unit and the first partial web formed thereon through a second wire unit, successive to the first wire unit, so that the first wire of the first wire unit meets a second wire of the second wire unit and defines a two-wire stretch with the second wire in the second wire unit, the two-wire stretch defining a forward end of the two wire stretch where the first wire meets the second wire, and a first side defined by the first wire and a second side defined by the second wire;

forming a second pulp layer atop the first partial web with a second pulp suspension jet supplied by a second headbox, at a forward end of the second wire unit;

subjecting the second pulp layer atop the first partial web to non-pulsating dewatering in at least a first dewatering zone of the two-wire stretch of the second wire unit, with a fixed formation shoe having a leading edge and a curved cap, which shoe is located at the forward end of the two-wire stretch, wherein the non-pulsating dewatering takes place by moving the twin wire stretch and the first partial web with the second pulp layer atop over the curved cap which is placed against the second side of the two-wire stretch, wherein the first partial web with second pulp layer atop is subjected to non-pulsating dewatering in the first dewatering zone by drawing water from the first partial web with second pulp layer atop through openings in the cap formed by holes or by gaps essentially in the lengthwise direction of the machine which extend through the cap, and affecting the dewatering of the first partial web with the second pulp layer atop with an under-pressure through the openings of the cap in an area following after the leading edge of the fixed formation shoe so that the leading edge of the fixed formation shoe does not remove water from the first partial web with the second pulp layer atop;

subjecting the first partial web with second pulp layer atop to pulsating dewatering in a second and downstream dewatering zone in the two-wire stretch of the second wire unit with fixed dewatering lists which are placed against the first side or the second side of the two-wire stretch, the fixed lists extending in the cross machine direction and between which there are gaps which extend in a cross machine direction, through which gaps under-pressure is drawn whereby the first partial web with the second pulp layer atop travelling in between the wires of the two-wire stretch is subjected to pulsating dewatering by the fixed dewatering lists, and by under-pressure in the gaps of the fixed dewatering lists;

wherein the step of subjecting the first partial web with second pulp layer atop to pulsating dewatering in the second and downstream dewatering zone includes controllably loading a plurality of moveable lists against the first side or the second side of the two-wire stretch, opposite the fixed dewatering lists, at the gaps between the fixed dewatering lists;

wherein the step of forming the first partial web on the first wire with the pulp suspension jet comprises supplying the suspension jet in to a jaw at a forward end of the first wire unit, the jaw being defined by the first wire and a superpostioned wire forming a first two-wire stretch, the first two wire stretch defining a beginning where the first wire and the superpostioned wire first meet;

accomplishing dewatering in a first dewatering zone of the first wire unit as non-pulsating dewatering with another fixed formation shoe having a leading edge and a curved cap, which shoe is located at the beginning of a first two-wire stretch formed of the first wire and an another wire, wherein the non-pulsating dewatering takes place by moving the first two-wire stretch over the curved cap which is placed against one side of the first two-wire stretch, wherein fiber pulp traveling in-between the first wire and the another wire is non-pulsatingly dewatered in the first dewatering zone by drawing water from the fiber pulp traveling in-between the formation wires through openings in the cap which extend through the cap, and affecting the dewatering of fiber pulp traveling in-between the first wire and the another wire with an under-pressure effected through the openings of the cap in an area following after the leading edge so that the leading edge of the fixed formation shoe does not remove water from the fiber pulp traveling in between the first wire and the another wire; and accomplishing dewatering in a second dewatering zone of the first wire unit as pulsating dewatering with fixed dewatering lists, located on one side of the first two-wire stretch downstream of the first dewatering zone of the first wire unit and dewatering with controlled loading moveable lists which are located on a side of the first two-wire stretch which is opposite the fixed dewatering lists, the controlled loading moveable lists positioned at the gaps between the fixed dewatering lists.

2. A method of forming a multi-layer web in a formation section, comprising the steps of:

forming a first partial web on a first wire of a first wire unit with a first pulp suspension jet supplied by a first headbox at a forward end of the first wire unit;

guiding the first wire of the first wire unit and the first partial web formed thereon through a second wire unit, successive to the first wire unit, so that the first wire of the first wire unit meets a second wire of the second wire unit and defines a two-wire stretch with the second wire in the second wire unit, the two-wire stretch defining a forward end of the two wire stretch where the first wire meets the second wire, and a first side defined by the first wire and a second side defined by the second wire;

forming a second pulp layer atop the first partial web with a second pulp suspension jet supplied by a second headbox, at a forward end of the second wire unit;

performing non-pulsating dewatering of the second pulp layer atop the first partial web in at least a first dewatering zone of the two-wire stretch of the second wire unit, with a fixed first formation shoe having a leading edge and a curved cap, which shoe is located at the forward end of the two-wire stretch, wherein the non-pulsating dewatering takes place by moving the twin wire stretch and the first partial web with the second pulp layer, over the curved cap which is, placed against the second side of two-wire stretch, wherein the first partial web with the second pulp layer undergoes non-pulsating dewatering in the first dewatering zone by drawing water from the first partial web with the second pulp layer through openings in the cap formed by holes or by gaps essentially in the lengthwise direction of the machine which extend through the cap, and effecting the dewatering of the first partial web with second pulp layer with an under-pressure through the openings of the cap in an area following after the leading edge of the first fixed formation shoe so that the leading edge of the first fixed formation shoe does not remove water from the first partial web with second pulp layer;

performing pulsating dewatering of the first partial web with the second pulp layer in a second and downstream dewatering zone in the two-wire stretch of the second wire unit with fixed dewatering lists which are placed against the first side or the second side of the two-wire stretch, the fixed lists extending in the cross machine direction and between which there are gaps which extend in a cross machine direction, through which gaps under-pressure is drawn whereby the first partial web with the second pulp layer traveling in-between the wires of the two-wire stretch is subjected to pulsating dewatering by the fixed dewatering lists, and by under-pressure in the gaps of the fixed dewatering lists;

wherein the non-pulsating dewatering produces a dry-matter content in the second pulp layer such that the second pulp layer is improved in formation by the pulsating dewatering.

3. The method of claim 2 wherein the step of performing pulsating dewatering of the first partial web with the second pulp layer in the second and downstream dewatering zone includes controllably loading a plurality of moveable lists against the first side or the second side of the two wire stretch opposite the fixed dewatering lists, at the gaps between the fixed dewatering lists.

4. The method of claim 2 wherein the step of forming the first partial web on the first wire with the first pulp suspension jet comprises forming the first partial web on a fourdrinier wire of a fourdrinier wire unit.

5. The method of claim 4, wherein the first pulp suspension jet directs fiber pulp on the fourdrinier wire and further comprising dewatering the fiber pulp on the fourdrinier wire in a first fourdrinier dewatering zone and a second, successive fourdrinier dewatering zone.

6. The method of claim 5, wherein the step of dewatering in the first fourdrinier dewatering zone is accomplished as non-pulsating dewatering with a fixed fourdrinier formation shoe having a leading edge and a curved cap, which shoe is located at an impact point formed by the first pulp suspension jet with the fourdrinier wire, wherein the non-pulsating dewatering takes place by moving the fourdrinier wire over the curved cap which is placed against an inner surface of the fourdrinier wire, and wherein the nonpulsating dewatering of the fiber pulp takes place in the first dewatering zone by drawing water from the fiber pulp through openings in the cap which extend through the cap, and affecting the dewatering of the fiber pulp with an under-pressure affected through the openings of the cap in an area following after the leading edge.

7. The method of claim 6, wherein the step of dewatering in the second fourdrinier dewatering zone is accomplished as non-pulsating dewatering with a further fixed fourdrinier formation shoe having a leading edge and a curved cap, which further shoe is located at a impact point formed by the second pulp suspension jet with the fourdrinier wire, and wherein the non-pulsating dewatering takes place by moving the fourdrinier wire over the curved cap which is placed against the inner surface of the fourdrinier wire, and wherein fiber pulp discharged by the second pulp jet is non-pulsatingly dewatered in the first dewatering zone by drawing water from the fiber pulp through openings in the cap which extend through the cap, and affecting the dewatering of the fiber pulp with an under-pressure effected through the openings of the cap in an area following after the leading edge.

8. The method of claim 2 wherein the step of forming the first partial web on the first wire with the pulp suspension jet comprises supplying the fiber pulp from the first pulp suspension jet in to a jaw at a forward end of the first wire unit, the jaw being defined by the first wire and a superpositioned wire defining a first two-wire stretch, the first two-wire stretch defining a beginning where the first wire and the superpositioned wire first meet.

9. The method of claim 8 further comprising dewatering the fiber pulp on the first two-wire stretch in a first non-pulsating dewatering zone and a second, successive pulsating dewatering zone of the first wire unit.

10. The method of claim 9, wherein the step of dewatering in the first dewatering zone of the first wire unit is accomplished as non-pulsating dewatering with a fixed formation shoe having a leading edge and a curved cap, which shoe is located at the beginning of the first two-wire stretch, wherein the non-pulsating dewatering takes place by moving the first two-wire stretch over the curved cap which is placed against one side of the first two-wire stretch, wherein the fiber pulp traveling in between the wires of the first two-wire stretch is non-pulsatingly dewatered in the first dewatering zone by drawing water from the fiber pulp traveling in between the wires of the first two-wire stretch through openings in the cap which extend through the cap, and affecting the dewatering of the fiber pulp traveling in-between the wires of the first two-wire stretch with an under-pressure affected through the openings of the cap in an area following after the leading edge so that the leading edge of the first fixed formation shoe does not remove water from fiber pulp on the first two-wire stretch in a first non-pulsating dewatering zone.

11. The method of claim 9, wherein the step of dewatering in the first dewatering zone of the first wire unit is accomplished as non-pulsating dewatering at the beginning of the two-wire stretch of the first wire unit by two successive fixed formation shoes, which are located on opposite sides of the two-wire stretch and which each have a curved cap provided with openings extending through the cap, and wherein under-pressure is affected through the each cap's openings, whereby fiber pulp traveling in-between the first formation wire and the first upper formation wire is subjected to non-pulsating dewatering by the two successive fixed formation shoes.

12. The method of claim 9, wherein the step of dewatering in the second dewatering zone of the first wire unit is accomplished as pulsating dewatering by first fixed dewatering lists, which are placed against one side of the two-wire stretch in the cross machine direction, the first fixed dewatering lists defining gaps in between the lists wherein fiber pulp traveling in between the wires of the two-wire stretch is subjected to pulsating dewatering by the first fixed dewatering lists and by an under-pressure in the area of the first fixed dewatering lists.

13. The method of claim 12, wherein the step of dewatering in the second dewatering zone of the first wire unit is accomplished as pulsating dewatering by the first fixed dewatering lists, and by controlled loading moveable lists which are located opposite the first fixed dewatering lists at the gaps between the first fixed dewatering lists.

14. The method of claim 2 wherein the fixed first formation shoe cap defines a total surface area and wherein water is drawn through 50-90 percent of the total surface area of the cap.

15. The method of claim 2 wherein the fixed first formation shoe draws water through the openings in the cap along an angle of 30-60 degrees between central axes of the openings and a tangent to the cap's outer surface obliquely against a traveling direction defined by the first formation wire.

16. The method of claim 2 wherein the twin wire stretch moves about a radius of curvature of 1-5 m as the twin wire stretch moves over the fixed first formation shoe.

17. The method of claim 2 wherein non-pulsating dewatering is performed by the fixed first formation shoe in such a way that an overlap angle of the formation wire traveling over the formation shoe is 3-45 degrees in an area defined by the cap.

18. A multi-layer web formation section, comprising:

a first wire unit for forming a first partial web, having a first wire, the first wire unit having a forward end and an output end;

a first headbox arranged to supply a pulp suspension jet to the forward end of the first wire unit;

a second wire unit succeeding the first wire unit, the second wire unit having a two-wire stretch formed of the first wire and a second wire, the first wire and the second wire forming a closing jaw at a second forward end where the first wire and the second wire come together, and forming a second output end where the first wire and the second wire are separated from one another, and wherein a first partial web formed in the first wire unit is arranged to be guided on the first wire of the first wire unit to the two-wire stretch of the second wire unit;

a second headbox located at the second forward end of the two-wire stretch of the second wire unit and which is arranged to supply a new pulp layer in to the closing jaw;

a first dewatering zone formed by a fixed first formation shoe having a leading edge, and a curved cap positioned on one of the first wire and the second wire of the two-wire stretch of the second wire unit and located at the forward end of the two-wire stretch, the at least one fixed first formation shoe having the curved cap placed against the second wire of the two-wire stretch, the cap having portions defining openings which extend through the cap, which openings are connected to a source of under pressure, wherein the openings are formed by holes or by gaps extending essentially in the lengthwise direction of the machine, such that fiber pulp traveling in-between the first wire and the second wire of the two-wire stretch is subjected to non-pulsating dewatering in an area following after the leading edge of the first formation shoe so that the leading edge of the fixed first formation shoe is arranged not to remove water from fiber pulp traveling in between the two-wire stretch formed of the first wire and the second wire of the two-wire stretch; and a second dewatering zone positioned after the first dewatering zone along the two-wire stretch of the second wire unit and formed by fixed dewatering cross machine direction extending lists placed against one of the first wire and the second wire of the two-wire stretch of the second wire unit, the lists defining gaps between the lists, the gaps connected to a source of under pressure so that the fiber pulp traveling in between the first wire and the second wire is subjected to pulsating dewatering by the fixed dewatering lists and by under-pressure.

19. The multi-layer web formation section of claim 18 wherein the second dewatering zone of the second wire unit also comprises loadable dewatering lists of the type which are structured so as to be loaded in a controlled manner, and which are located on an opposite side of the two-wire stretch in relation to the fixed dewatering lists at the gaps between the fixed dewatering lists.

20. The multi-layer web formation section of claim 18 wherein the first wire unit is a fourdrinier wire unit, and the first headbox is arranged to supply the pulp suspension jet on to the first wire which is a fourdrinier wire.

21. The multi-layer web formation section of claim 20, wherein the fourdrinier wire unit has two successive dewatering zones.

22. The multi-layer web formation section of claim 21, wherein the first dewatering zone of the fourdrinier wire unit is formed by a fixed fourdrinier formation shoe which is located at the beginning of the first fourdrinier wire unit at a point where the pulp suspension jet is arranged to impact the fourdrinier wire, the fixed fourdrinier formation shoe having a curved cap placed against an inner surface of the fourdrinier wire and having portions defining openings extending through the cap, the openings connected to a source of under-pressure, so that the fixed fourdrinier formation shoe is arranged to subject a fiber pulp traveling on the fourdrinier wire to non-pulsating dewatering in an area following after a leading edge of the fixed fourdrinier formation shoe.

23. The multi-layer web formation section of claim 22, wherein the second dewatering zone of the fourdrinier wire unit is formed by a second fixed fourdrinier formation shoe, which is located at the output end of the first fourdrinier wire unit at a point where the second headbox is arranged to impact a pulp suspension jet to form the new pulp layer, the second fixed fourdrinier formation shoe having a curved cap placed against an inner surface of the fourdrinier wire and having portions defining openings extending through the cap, the openings connected to a source of under-pressure, so that the second fixed fourdrinier formation shoe is arranged to subjected a fiber pulp traveling on the fourdrinier wire to non-pulsating dewatering in an area following after a leading edge of the second fixed fourdrinier formation shoe.

24. The multi-layer web formation section of claim 18 wherein the first wire unit is a wire unit equipped with a superpostioned wire forming a first two-wire stretch with the first wire and forming a first jaw at the forward end of the first wire unit, the two-wire stretch defining a beginning where the first wire and the superpostioned wire first meet, and wherein the first headbox is arranged to supply the pulp suspension jet into the first jaw.

25. The multi-layer web formation section of claim 24 wherein there are two successive dewatering zones in the two-wire stretch of the first wire unit.

26. The multi-layer web formation section of claim 25, wherein the first dewatering zone of the first wire unit is formed by a fixed second formation shoe, which is located at the beginning of the two-wire stretch of the first wire unit on one side of the two-wire stretch and which fixed second formation shoe has a curved cap placed against the one side of the two-wire stretch and the fixed second formation shoe has portions defining openings extending through the cap, the openings connected to a source of under-pressure, so that the fixed second formation shoe is arranged to subject fiber pulp traveling between the first forming wire and the superpostioned forming wire to non-pulsating dewatering in an area following after a leading edge of the fixed second formation shoe.

27. The multi-layer web formation section of claim 25, wherein the first dewatering zone of the first wire unit is formed by two successive fixed second formation shoes, which are located at the beginning of the two-wire stretch of the first wire unit on opposite sides of the two-wire stretch and wherein each of the two successive fixed second formation shoes has a curved cap, and each of the two successive fixed second formation shoes has portions defining openings extending through the caps and connected to a source of under-pressure so that fiber pulp traveling in between the first formation wire and the superpostioned forming wire is subjected to non-pulsating dewatering in an area defined by the two successive fixed second formation shoes.

28. The multi-layer web formation section of claim 25, wherein a second dewatering zone of the two successive dewatering zones of the two-wire stretch of the first wire unit is formed by fixed dewatering lists, which are placed against one side of the two-wire stretch in the cross machine direction and which define gaps between the lists which are connected to a source of under-pressure so that the fiber pulp traveling in-between the formation wires of the two-wire stretch is subjected to pulsating dewatering by the fixed dewatering lists and by under-pressure in an area defined by the fixed dewatering lists.

29. The multi-layer web formation section of claim 28 wherein the second dewatering zone of the first wire unit further comprises loadable dewatering lists, of the type which are structured so as to be loaded in a controlled manner, and which are located on the opposite side of the two-wire stretch in relation to the fixed dewatering lists at the gaps between the fixed dewatering lists.

30. The multi-layer web formation section of claim 18, wherein a quantity of open surface area defined by the openings of the cap of the first formation shoe is 50-90 percent of a total surface area defined by the cap.

31. The multi-layer web formation section of claim 18, wherein the holes extending through the cap of the first formation shoe are orientated obliquely against a traveling direction defined by the first formation wire, so that the holes form an angle of 30-60 degrees between central axes of the holes and a tangent to an outer surface defined by the cap.

32. The multi-layer web formation section of claim 18, wherein the cap has a radius of curvature of 1-5 m.

33. The multi-layer web formation section of claim 18 wherein the first formation wire has an overlap angle of 3-45 degrees with respect to an area defined by the cap of the first formation shoe.

* * * * *